US009278247B2

(12) United States Patent
Kristiansen

(10) Patent No.: US 9,278,247 B2
(45) Date of Patent: Mar. 8, 2016

(54) ERGONOMIC PULL HANDLE AND ASSOCIATED EXERCISE METHODS

(71) Applicant: David Kristiansen, Freeport, NY (US)

(72) Inventor: David Kristiansen, Freeport, NY (US)

( * ) Notice: Subject to any disclaimer, the term of this patent is extended or adjusted under 35 U.S.C. 154(b) by 0 days.

(21) Appl. No.: 14/601,879

(22) Filed: Jan. 21, 2015

(65) Prior Publication Data

US 2015/0196795 A1 Jul. 16, 2015

Related U.S. Application Data

(63) Continuation of application No. 13/035,958, filed on Feb. 26, 2011, now Pat. No. 8,944,978, which is a continuation-in-part of application No. 12/611,799, filed on Nov. 3, 2009, now Pat. No. 8,360,941.

(60) Provisional application No. 61/110,609, filed on Nov. 3, 2008.

(51) Int. Cl.
*A63B 71/00* (2006.01)
*A63B 21/00* (2006.01)

(52) U.S. Cl.
CPC ..... *A63B 21/1496* (2013.01); *A63B 21/4049* (2015.10); *A63B 71/00* (2013.01)

(58) Field of Classification Search
CPC . A63B 21/1496; A63B 21/4049; A63B 71/00
See application file for complete search history.

(56) References Cited

U.S. PATENT DOCUMENTS

| | | | | |
|---|---|---|---|---|
| 1,372,026 | A * | 3/1921 | Hutter | 482/123 |
| 1,623,670 | A * | 4/1927 | Frankenfeld | 482/123 |
| 6,544,148 | B1 * | 4/2003 | Loew | 482/82 |
| 7,473,213 | B1 * | 1/2009 | Kallenbach | 482/139 |
| 2008/0108484 | A1 * | 5/2008 | Wu et al. | 482/122 |
| 2010/0009816 | A1 * | 1/2010 | Edmondson | 482/72 |
| 2011/0195825 | A1 * | 8/2011 | Liester | 482/120 |

* cited by examiner

*Primary Examiner* — Glenn Richman
(74) *Attorney, Agent, or Firm* — Maceiko IP

(57) ABSTRACT

A pull handle that is ergonomically designed to avoid unnatural stresses and/or discomfort to the user's body and joints through the range of motion. The invention enables a user to perform exercises that cannot be accomplished with existing handles or may be more difficult or uncomfortable to do so. These objects are achieved by providing one or more axes of rotation or flexibility in the pull handle so that the user's hand, wrist and/or arm (or foot, ankle and/or leg) may bend and/or rotate more naturally through the user's range of motion.

7 Claims, 15 Drawing Sheets

X
Y
1
10
10A
10B
10C
10D
12
12A
12B
12C
12D
14
14A
14B
14C
14D
14E
14F
14G
14H
14I
14J

ERGONOMIC PULL HANDLE AND ASSOCIATED EXERCISE METHODS

CROSS REFERENCE TO RELATED APPLICATIONS

This application is a continuation of U.S. patent application Ser. No. 13/035,958, filed on Feb. 26, 2011, which is a continuation-in-part of U.S. patent application Ser. No. 12/611,799, filed Nov. 3, 2009, now U.S. Pat. No. 8,360,941, which in turn claims the benefit of U.S. Provisional Application Ser. No. 61/110,609, filed Nov. 3, 2008, the contents of which are incorporated by reference as if fully set forth herein.

FIELD OF THE INVENTION

The invention generally relates to exercise equipment and methods of exercising, including a pull handle that may be attached to various forms of resistance, and exercising in an ergonomic fashion.

BACKGROUND OF THE INVENTION

Many forms of exercise equipment involve pull handles connected to cables, weights and other forms of resistance. The user typically grasps the pull handle to lift the weight, pull the cable or effect some other type of movement against the resistance. A problem with existing pull handles is that they have a fixed point of attachment to a source of resistance and therefore offer a limited range of mobility and do not account for the rotation of the user's hand, wrist and/or arm (or foot, ankle and/or leg) as the user extends through the range of motion associated with the particular exercise. This may create unnatural stress on the user's joints, ligaments and/or tendons that may result in injury. It also limits the type of exercises that can be performed using the handle. Another problem with existing pull handles is that their forms lead to discomfort when performing certain exercises and preclude the performance of other exercises altogether, especially functional exercises that focus on the human body's natural movements.

These issues exist with single pull handles that may be held in either of the user's hands, as well as with exercise bars that may be used with lat pull-down or other similar exercises where two pull handles are used at the same time in each of the user's hands.

In view of the foregoing, there is a need for a pull handle that addresses the above described issues such as relieving unnatural stress on the user's joints when performing exercises. There is also a need for a pull handle that relieves or mitigates the discomfort caused by existing pull handles during the performance of certain exercises. There is also a need for different methods of exercise that may be performed with one or more pull handles that address these issues.

SUMMARY OF THE INVENTION

It is an object of the invention to provide a pull handle that is ergonomically designed to avoid unnatural stresses on the user's body through the range of motion. It is another object of the invention to enable a user to perform exercises that cannot be accomplished with existing handles or may be more difficult, uncomfortable or painful to do so. These objects are achieved by providing (i) one or more axes of rotation or flexibility in the pull handle so that the user's hand, wrist and/or arm (or foot, ankle and/or leg) may bend and/or rotate more naturally through such user's range of motion and (ii) a handle and/or attachment that alleviates or mitigates the discomfort caused by other handles and/or attachments.

The ergonomic pull handle of the invention is suited for use with a variety of exercise equipment. For example, the ergonomic pull handle may be attached to or form part of the ends of any type of bar, e.g., bar bells, pull-up bars, lat pull-down bars, etc. The ergonomic pull handle of the invention may also be attached to the ends of cables that are pulled by the user.

The ergonomic pull handle of the invention is also suited for other applications beyond exercise equipment. For example, it may be used as a handle to attach to the end of a lawn mower pull cable or a suitcase, or for any other application that involves a person exerting himself or herself through a range of motion.

DETAILED DESCRIPTION OF THE PREFERRED EMBODIMENTS

Figure 1:
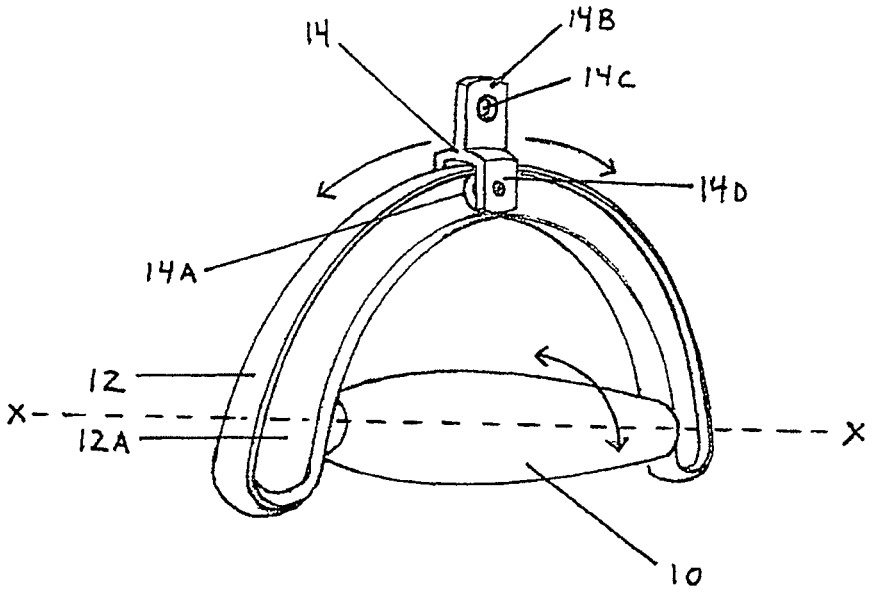
FIG. 1 is a perspective view of a pull handle of the present invention.

A preferred embodiment of the ergonomic pull handle 1 of the current invention is shown in FIGS. 8, 8A, 8B, 8C, 8D, 8E and FIG. 4. As shown, pull handle 1 may include a handle or grip 10 which may be grasped by the user and track or curved member 12 attached to handle 10, such as being attached at the ends of handle 10. Grip 10 is preferably round and textured so that it is comfortable for the user to grasp and will limit slipping, or it may be oblong or other shape and may have a smooth finish or other texture. Track member 12 is preferably curved, and may be semi circular as shown. However, elliptical and other shapes may be used for track member 12. Track or curved member 12 preferably includes a groove 12A that accommodates bracket 14. As discussed in more detail below, bracket 14 may travel along the groove 12A of member 12 as the user performs an exercise. Track members 12, 12B, and 12C may preferably be made with aluminum for a combination of strength and lightness, but may be made with composites or other materials.

Figures 8, 8A, 8B, 8C, 8D, 8E:
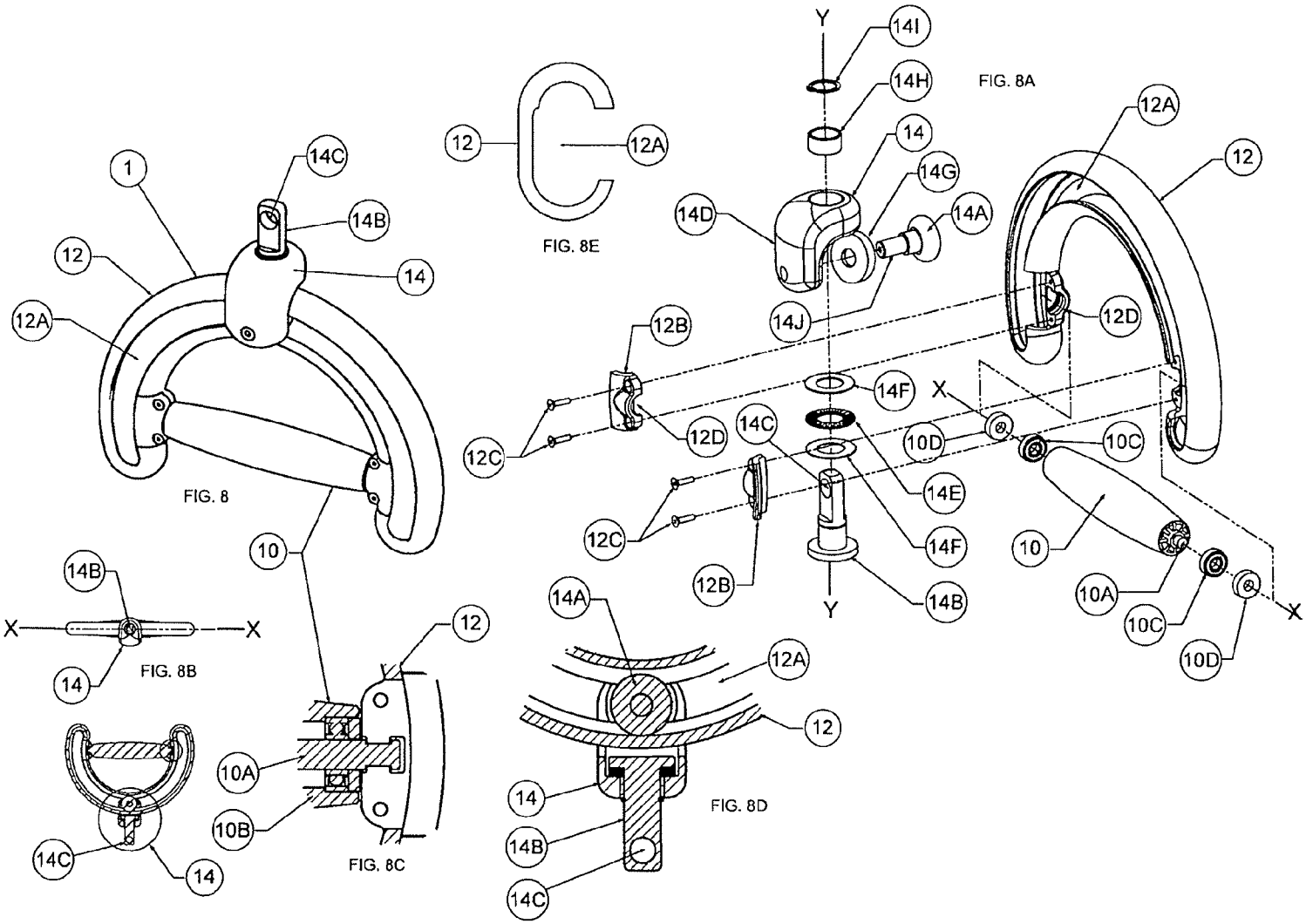
FIG. 8 is a perspective view of a preferred embodiment of the present invention.
FIG. 8A is an assembly drawing of the pull handle of FIG. 8.
FIG. 8B is a top view of the pull handle of FIG. 8.
FIG. 8C is a detailed sectional view of the connection between the rod, handle and track.
FIG. 8D is a detailed sectional view of the connection of the bracket and track.
FIG. 8E is a sectional view of the track.

As shown in FIGS. 8A and 8C, handle or grip 10 may include a bore or hollow section 10B through which rod 10A extends. Handle or grip 10 may preferably be made with aluminum for a combination of strength and lightness, but may be made with composites or other materials or combinations thereof. Handle or grip 10 may preferably rotate about axis X of rod 10A. The ends of rod 10A preferably extend beyond the ends of handle 10 to engage the curved member 12 described later in connection with FIG. 8C. Rod 10A may preferably be machined from stainless steel for strength and corrosion resistance (such as resistance to sweat), but may be made with composites or other materials. Bearings 10C may be positioned between handle 10 and rod 10A to allow handle 10 to rotate about its axis X and to prevent friction between handle 10 and rod 10A. Washers 10D may be attached near the ends of grip 10 so that the bearings and other internal components are sealed and to prevent the ends of handle 10 from rubbing against and creating friction with track 12. The washers can be made of nylon, plastic or any other material, but preferably a material with low friction properties.

Also, as shown in FIGS. 8A and 8C, track or curved member 12 may include removable portions 12B, which may be centered near the diametrical axis of track 12, i.e., centered on or near the axis that runs through the diameter of track 12, and which may be attached to curved member 12 through rivets or screws 12C. Other types of fasteners 12C may be used besides rivets or screws.

Removable portions 12B may include a bore 12D so that when removable portions are attached to curved member 12, a bore is formed to receive the ends of rod 10A. The bore 12D and rod 10A may be sized so that they are fixedly coupled. Alternatively, they may be sized so that ends 10A may rotate within bores 12D. Either way, handle 10 may rotate about its axis X. That is, handle 10 may rotate about rod 10A, or handle 10 and rod 10A may be fixedly attached and the ends of rod 10A rotate within the bore 12D. In this or other suitable manner, grip 10 is rotatably coupled to curved member 12. The rotation thus provided allows a degree of movement of the ergonomic pull handle 1 thereby protecting the user. In this manner, for example, the pull handle provides a direction or type of motion between the user and the weight or resistance to which the pull handle is attached.

The track member 12 may have a C-shaped cross section as shown in FIG. 8E. This C-shaped cross section may form the groove 12A mentioned above. Bracket 14 may be moveably mounted to track member 12 as shown in FIG. 8, FIG. 8A, and FIG. 8D. Preferably, bracket 14 may move along and/or within groove 12A.

Bracket 14 may include a flange 14D that may be positioned to the side of track member 12. As shown in FIG. 8B, it is preferred that the flange 14D is generally L-shaped so that it extends over the top of track member 12 so that tab 14B is generally centered on track 12 and axis X. However, other shapes may be used. As discussed below, this provides that the point of attachment 14C and thus pull handle 1, is generally in line with the cable or other device to which pull handle 1 is attached. This provides safety and smooth performance for the user.

The flange 14D may be connected to a wheel 14A that is preferably sized to slide along and/or within the groove 12A, thereby allowing bracket 14 and thus the point of attachment, e.g., attachment to a cable, to rotate around or otherwise travel about the circumference or pathway of groove 12A of track 12. The wheel can be made of a variety of materials, but preferably a material that will not distort or bind under heavy loads. The wheel may be rotatably mounted to an axle 14J with ball bearings for smooth operation. Axle 14J may have a threaded end which can be screwed into flange 14D or fixedly attached by other means. Axle 14J may have a wider diameter or some other stop means to maintain a specific distance between wheel 14A and flange 14D. Alternately, axle 14J may be cast or machined as an integral part of flange 14D. Wheel 14A may also be fixedly connected to axle 14J which may be rotatably connected to flange 14D and thus bracket 14. Either way, wheel 14A may be attached to flange 14D in such a way to allow wheel 14A to rotate in relation to flange 14D and thus bracket 14.

Groove 12A and wheel 14A may be a variety of corresponding shapes such as convex and concave or V groove and V ridge. It is preferred that the wheel 14A and groove 12A interact smoothly so that the pull handle 1 provides safety and smooth performance throughout the user's range of motion. For example, it is preferred that the wheel 14A and groove 12A do not bind up to avoid a sudden stop or start during the user's range of motion. Groove 12A may extend to each end of track 12 so that wheel 14A can travel to the ends of the track and allow bracket 14 to rotate around the ends of track 12 without binding, and thus provide additional degrees of movement between handle 1 and bracket 14, and therefore between handle 1 and the direction of the resistance connected to bracket 14.

While the embodiment described above contemplates the use of a wheel such as wheel 14A, the scope of the invention also contemplates other components that may travel about groove 12A. For example, a block of material with a curved and smooth outer surface, e.g., Teflon™, that may generally match the curve of the groove 12A may be used. Alternatively, a component that includes ball bearings preferably to allow bracket 14 to travel about groove 12A may be used.

A washer 14G may be applied to axle 14J to align bracket 14 with track 12 and thus aligning wheel 14A with groove 12A to prevent wheel 14A from binding with groove 12A and prevent bracket 14 from rubbing against track 12. Bracket 14 may also include a tab 14B that includes a hole 14C that allows the bracket 14, and thus the ergonomic pull handle 1, to be connected to, for example, a cable. Tab 14B may preferably be machined from stainless steel for strength and corrosion resistance, but may be made with composites or other materials with suitable tensile strength to support heavy weight. In use, bracket 14 will be able to slide along the track member 12 thereby providing another degree of movement of the ergonomic pull handle 1 thereby further protecting the user as the user extends through a range of motion. As mentioned above, this point of connection 14C is preferably positioned above track member 12.

Bracket 14 may also be configured so that the tab 14B may rotate relative to the rest of bracket 14. For example, the tab 14B may be connected to the rest of the bracket 14 by a thrust bearing assembly 14E and 14F, and/or a sleeve bearing 14H, or other mechanism that allows rotation of tab 14B about an axis Y extending upward. This provides another degree of movement that adds to the safety and comfort experienced by the user.

As shown in FIG. 8A, retaining ring 141 or a similar mechanism may be connected to tab 14B to keep tab 14B from sliding out of bracket 14 when not in use. Tab 14B may be rotatably connected to bracket 14 by being inserted through sleeve bearing 14H which may be pressed into tab 14. Sleeve bearing may be made of oil impregnated bronze or other material that minimizes friction between tab 14B and bracket 14.

FIG. 8D shows a section of bracket assembly 14 and its relationship to track 12 and groove 12C.

Tab 14B may also be altered, or fitted with attachments that will allow the handle to be connected to a variety of exercise and sports equipment, e.g., resistance bands or tubes, lever type exercise equipment, kite boards, etc. Alternatively, the handle may be attached to a variety of other equipment such as a suitcase or the end of a cable that is pulled to start a lawn mower.

An alternate embodiment of the ergonomic pull handle 1 of the current invention is shown in FIG. 1. As shown, pull handle 1 may include a handle or grip 10 which may be grasped by the user and track member 12 attached at the ends of handle 10. Grip 10 is preferably round and smooth so that it is comfortable for the user to grasp. Track member 12 may be semi circular as shown but elliptical and other shapes may be used. Track member 12 has two ends which are connected at or near the ends of grip 10.

Figure 2:
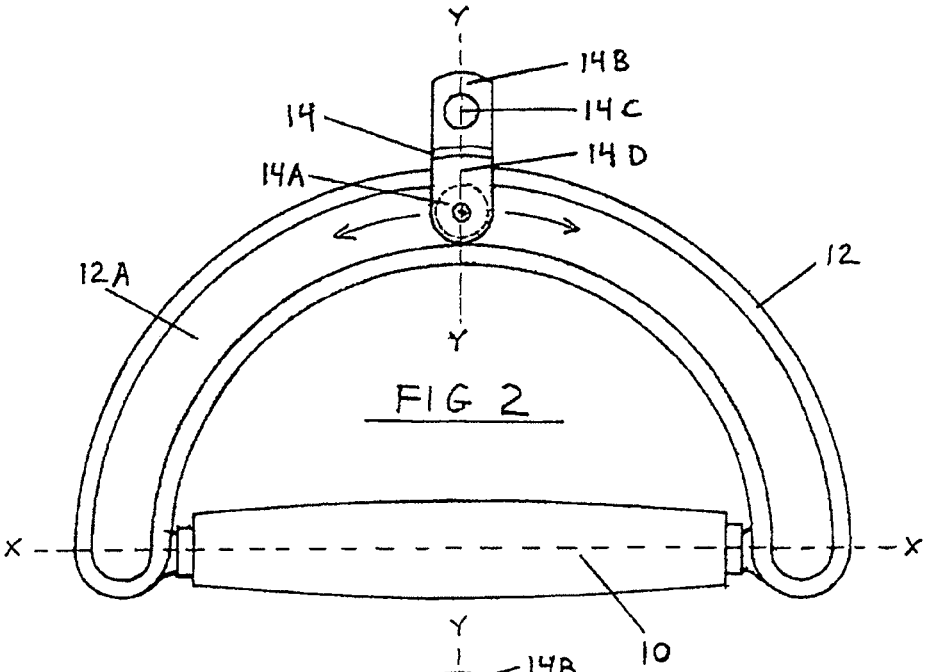
FIG. 2 is a side view of a pull handle of the present invention.
Figure 2A:
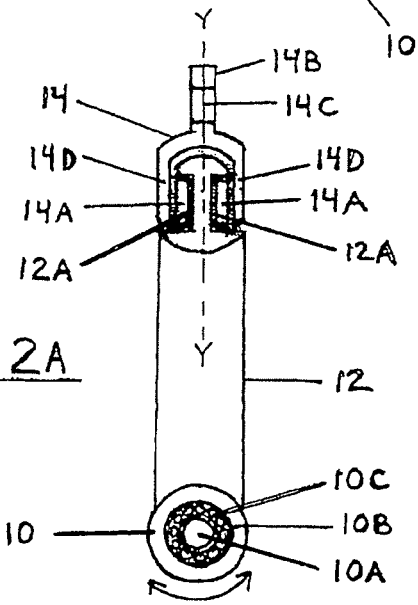
FIG. 2A is an end view of a pull handle of the present invention.

The length of grip 10 defines an axis X. The connection between grip 10 and track member 12 is such that grip 10 may rotate about axis X as shown. This may be accomplished several ways. For example, as shown in FIG. 2A, grip 10 may include a bore 10B down its axis X through which a rod 10A extends. There may be bearings 10C between grip 10 and the rod 10A that allow grip 10 to rotate in relation to the rod 10A. The ends of rod 10A may be fixedly connected to the ends of track member 12 such that grip 10 may rotate about axis X. This provides one degree of movement of the ergonomic pull handle 1 thereby protecting the user.

The track member 12 may have an I-shaped cross section as shown in FIG. 2A. To this end, the track member may include opposing grooves 12A that form the I-shaped cross section. Bracket 14 may be moveably mounted to track member as shown in FIG. 1, FIG. 2, and FIG. 2A. Bracket 14 may include two forks or flanges 14D that are located on either side of track member 12. Each flange may be connected to a wheel 14A that is sized to slide within the grooves 12A, thereby allowing bracket 14 and thus the point of attachment, e.g., attachment to a cable, to rotate around or otherwise travel about the circumference or pathway of grooves 12A of track 12. Bracket 14 may also include a tab 14B that includes a hole 14C that allows the bracket 14, and thus the ergonomic pull handle 1, to be connected to, for example, a cable. In use, bracket 14 will be able to slide along the track member 12 thereby providing another degree of movement of the ergonomic pull handle 1 thereby further protecting the user as the user extends through a range of motion.

Bracket 14 may also be configured so that the tab 14B may rotate relative to the rest of bracket 14. For example, the tab 14B may be connected to the rest of the bracket 14 by a bearing assembly similar to that existing between grip 10 and track member 12 or other mechanism that allows rotation of tab 14B about an axis Y extending upward. This provides another degree of movement that adds to the safety and comfort experienced by the user.

Tab 14B may also be altered, or fitted with attachments that will allow the handle to be connected to a variety of exercise and sports equipment, e.g., resistance bands or tubes, lever type exercise equipment, kite boards, etc. Alternatively, the handle may be attached to a variety of other equipment such as a suitcase or the end of a cable that is pulled to start a lawn mower.

The movable point of attachment provided by this assembly allows the user to perform exercises that cannot be performed with existing handles, or at least permits such exercises to be performed more safely and comfortably. FIGS. 3A-3D show two exercises that a user can perform with this invention, which cannot be performed with existing handles.

Figure 3A:
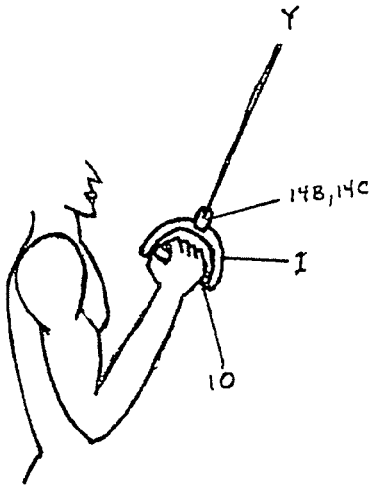
FIGS. 3A-3D show a pull handle of the present invention being used in a tricep exercise.
Figure 3B:
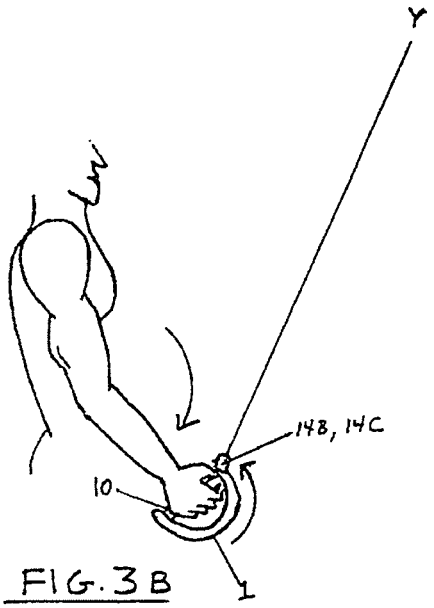

FIGS. 3A and 3B show a user performing a triceps exercise, where the handle is attached to a resistance cable that originates at a point above the users shoulders. FIG. 3A shows a user holding the handle 1 as though he or she were holding a hammer with his or her arm curled in an upward position. FIG. 3B shows how the point of attachment 14B, 14C travels about the track member 12 of the handle 1 as the user extends his or her arm in a downward motion, while maintaining the relative position of the user's hand, wrist and forearm. To facilitate comfort and safety, grip 10 may also rotate about axis Y should the user seek to curl his or her wrist during the downward movement, thereby providing another degree of movement. And if the user seeks to rotate his or her wrist during the downward movement, the rotation between the bracket 14 and the tab 14A provides yet another degree of movement. Such movements cannot be performed with existing handles without causing excessive and unnatural stress on the user's muscles, tendons and/or ligaments of the hand, wrist and/or forearm.

Figure 3C:
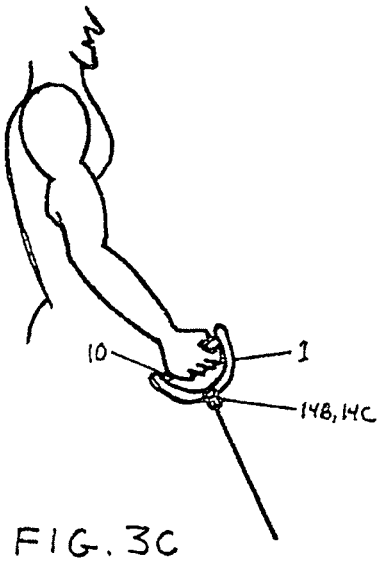
Figure 3D:
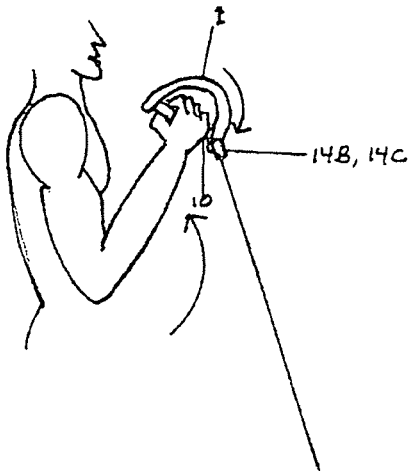
Figure 4:
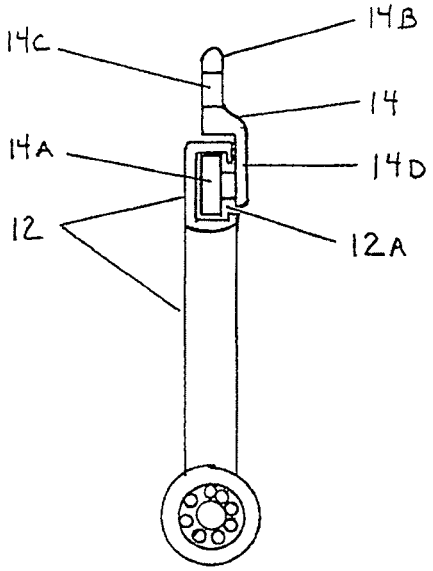
FIG. 4 is an end view of an alternate pull handle of the present invention.

FIGS. 3C and 3D show a user performing a bicep exercise, where the handle 1 is attached to a resistance cable that originates at a point below the user's elbow. FIG. 3A shows a user holding the handle as though he or she were holding a hammer with his or her arm extended downward. FIG. 3B shows how the point of attachment 14B, 14C travels about the track member 12 of the handle 1 as the user curls his or her arm in an upward motion, while maintaining the relative position of the user's hand, wrist and forearm. To facilitate comfort and safety, grip 10 may also rotate about axis Y should the user seek to curl his or her wrist during the upward movement. And if the user seeks to rotate his or her wrist during the upward movement, the rotation between the bracket 14 and the tab 14A provides yet another degree of movement. Such movements cannot be performed with existing handles without causing excessive and unnatural stress on the user's muscles, tendons and/or ligaments of the hand, wrist and/or forearm.

Figure 7A:
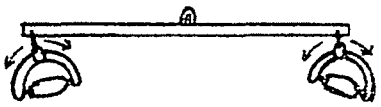
FIG. 7A is a side view of an exercise bar of the present invention having pull handles.
Figure 7B:
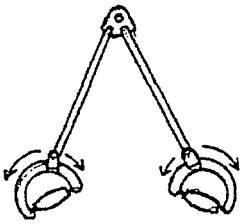
FIG. 7B is a side view of an alternate exercise bar of the present invention having pull handles.
Figure 7C:
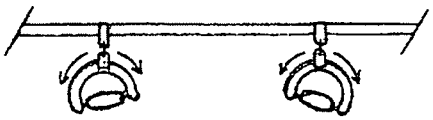
FIG. 7C is a side view of an alternate exercise bar of the present invention having alternate brackets to connect to a bar for pull-ups or other pulling exercises.
Figure 9:
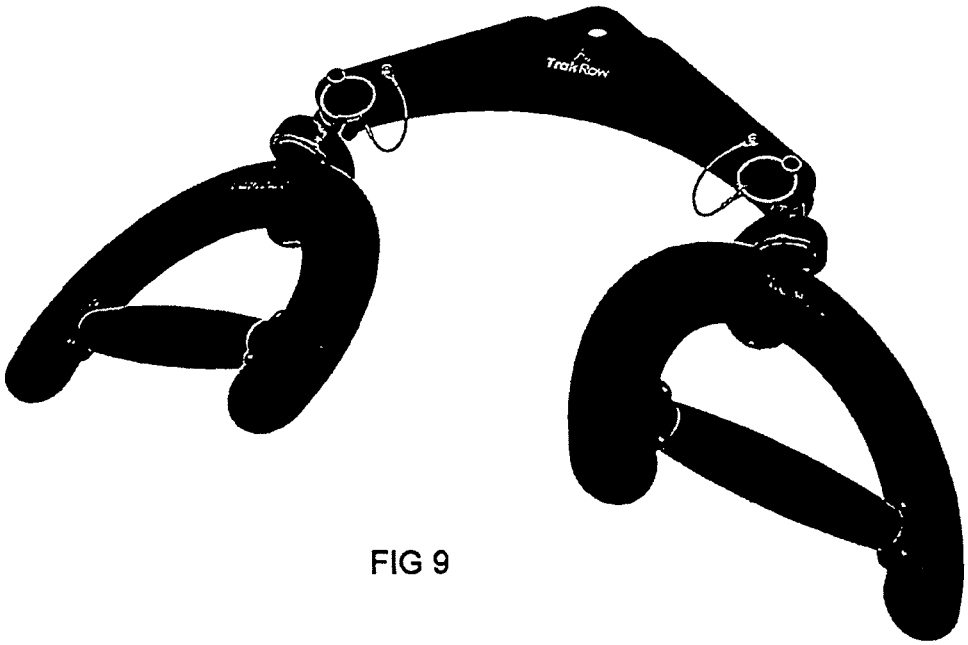
FIG. 9 is a perspective view of an exercise bar of the present invention having two pull handles.

The embodiment described above is suitable for use with a cable of an exercise machine (and/or resistance tubes or bands). However, the pull handle 1 of the invention may be incorporated into the ends of a bar, e.g., a lat pull-down bar as shown in FIG. 7A, a bar for rowing and other exercises as shown in FIG. 9, a v-handle pull-down bar as shown in FIG. 7B, a pull-up bar as shown in FIG. 7C, and/or lever type bars any fitness equipment. In each of these embodiments, degrees of movement may be provided by the rotation of grip 10 about axis A, the travel of bracket 14 about track member 12 and the rotation of the tab 14A in relation to the bracket 14.

Figure 7D:
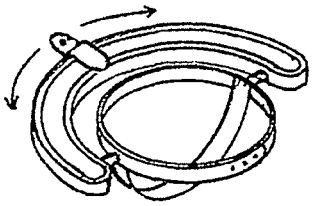
FIG. 7D is a perspective view of the present invention having a harness for attaching to a foot or ankle.

An alternate embodiment of this invention may include an ankle or foot strap in place of grip 10, as shown in FIG. 7D, therefore allowing the user to connect pull handle 1 to the user's foot or ankle thereby protecting the user during leg exercises.

Figure 7E:
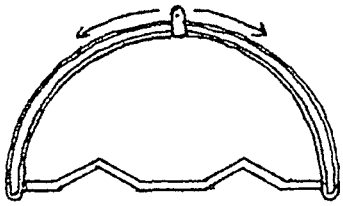
FIG. 7E is a side view of the present invention with a larger diameter track and alternate bar for use with two hands.
Figure 7F:
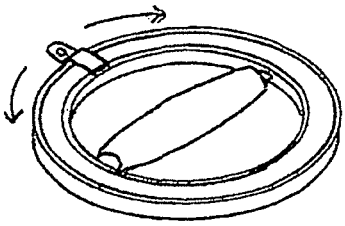
FIG. 7F is a perspective view of an alternate pull handle of the present invention.

In an alternate embodiment of this invention, track member 12 may be a complete circle or ellipse, as shown in FIG. 7F, thereby allowing bracket 14 to travel 360 degrees around grip 10 and/or said alternate ankle/foot strap.

In an alternate embodiment, the diameter of track member 12 may be significantly enlarged, as shown in FIG. 7E, thereby allowing grip 10 to be replaced with a variety of different members, e.g., a pull up bar, a pull down bar, a trapeze handle, etc.

In an alternate embodiment of this invention, track member 12 may have a different shaped cross section, e.g., a hollow rounded or square tube, or a solid round, square, or other shaped member. Bracket 14 may be altered to travel along the circumference of track member 12.

The handle 1 may be configured in a variety of alternate embodiments to allow the movable point of attachment described above to travel about the track member 12.

Figure 5A:
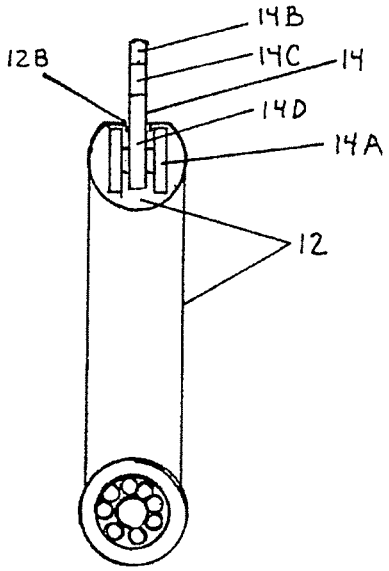
FIG. 5A is an end view of an alternate pull handle of the present invention.

FIG. 5A shows an alternative embodiment of this invention, where track 12 may have a round, oval, or other shaped hollow tubular cross section. Track 12 may include a slot 12B that extends around the outer perimeter of track 12. Bracket 14 may be altered to include a single fork or flange 14D inserted in the groove 12B. A wheel 14A sized to slide inside track 12, may be connected to one or both sides of flange 14D, thereby allowing bracket 14 and thus the point of attachment to rotate around the circumference of track 12. Bracket 14 may also include a tab 14B that includes a hole 14C that allows the bracket 14 and thus the ergonomic pull handle to be connected to, for example, a cable. The tab 14B may also be configured to rotate relative to the rest of the bracket 14. This embodiment provides the benefit that the moving wheels 14A may be enclosed within the track member 12 thus avoiding contact with the user.

Figure 5B:
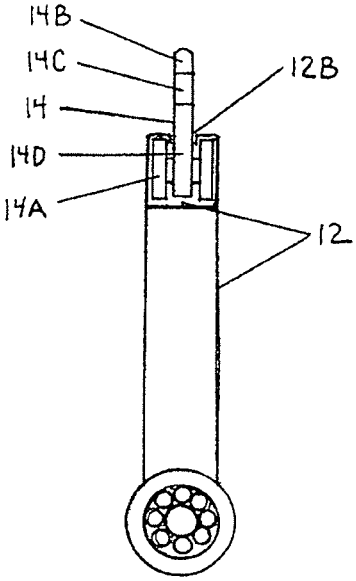
FIG. 5B is an end view of an alternate pull handle of the present invention.

FIG. 5B shows an alternative embodiment of this invention, where track 12 may have a square, rectangular or other shaped hollow tubular cross section. Track 12 may include a slot 12B that extends around the outer perimeter of track 12. Bracket 14 may be altered to include a single fork or flange 14D inserted in the groove 12B. A wheel 14A sized to slide inside track 12, may be connected to one or both sides of flange 14D, thereby allowing bracket 14 and thus the point of attachment to rotate around the circumference of track 12. Bracket 14 may also include a tab 14B that includes a hole 14C that allows the bracket 14 and thus the ergonomic pull handle to be connected to, for example, a cable. The tab 14B may also be configured to rotate relative to the rest of the bracket 14. This embodiment provides the benefit that the moving wheels 14A may be enclosed within the track member 12 thus avoiding contact with the user.

Figure 6A:
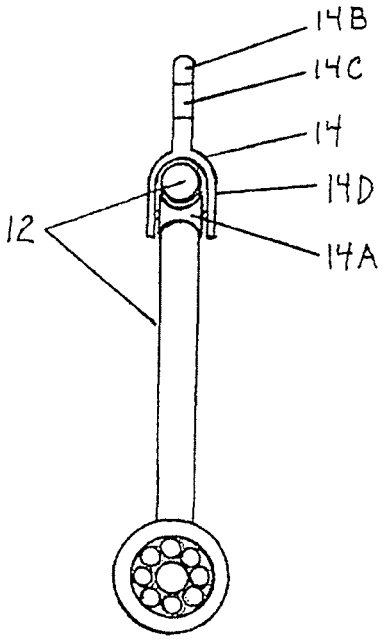
FIG. 6A is an end view of an alternate pull handle of the present invention.

FIG. 6A shows an alternative embodiment of this invention, where track 12 may have a round, oval, or other shaped solid cross section made of rigid material, such as steel or aluminum, or flexible material, such as cable or rope. Bracket 14 may include two forks or flanges 14D that are located on either side of track member 12. Each flange may be connected to a wheel 14A that is sized to slide along the inside perimeter of track 12, thereby allowing bracket 14 and thus the point of attachment to rotate around the circumference of track 12. Bracket 14 may also include a tab 14B that includes a hole 14C that allows the bracket 14 and thus the ergonomic pull handle to be connected to, for example, a cable. The tab 14B may also be configured to rotate relative to the rest of the bracket 14.

Figure 6B:
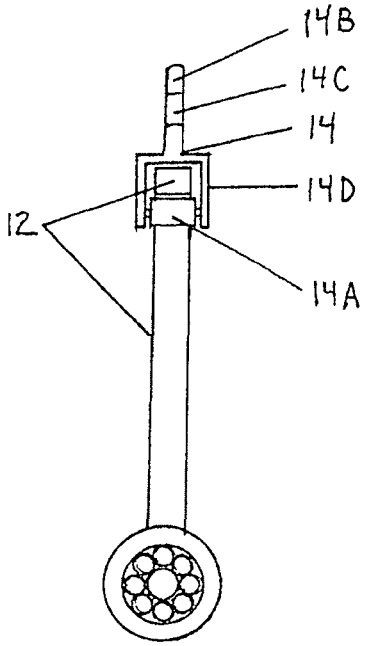
FIG. 6B is an end view of an alternate pull handle of the present invention.

FIG. 6B shows an alternative embodiment of this invention, where track 12 may have a square, rectangular, flat or other shaped solid cross section made of rigid material, such as steel or aluminum, or flexible material, such as a nylon strap or band. Bracket 14 may include two forks or flanges 14D that are located on either side of track member 12. Each flange may be connected to a wheel 14A that is sized to slide along the inside perimeter of track 12, thereby allowing bracket 14 and thus the point of attachment to rotate around the circumference of track 12. Bracket 14 may also include a tab 14B that includes a hole 14C that allows the bracket 14 and thus the ergonomic pull handle to be connected to, for example a cable. The tab 14B may also be configured to rotate relative to the rest of the bracket 14. This embodiment provides the benefit that the moving wheels 14A may be enclosed within the track member 12 thus avoiding contact with the user.

Figure 6C:
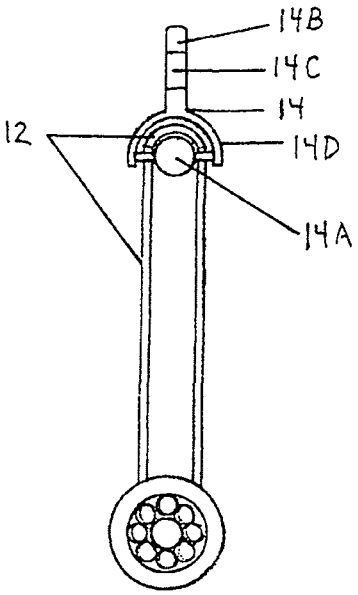
FIG. 6C is an end view of an alternate pull handle of the present invention.

FIG. 6C shows an alternative embodiment of this invention, where track 12 may include a concave or other shaped recess along the track's inside perimeter. Bracket 14 may include two forks or flanges 14D that are located on either side of track member 12. Each flange may be connected to a wheel 14A that is sized to slide within and along the concaved inside perimeter of track 12, thereby allowing bracket 14 and thus the point of attachment to rotate around the circumference of track 12. Bracket 14 may also include a tab 14B that includes a hole 14C that allows the bracket 14 and thus the ergonomic pull handle to be connected to, for example a cable. The tab 14B may also be configured to rotate relative to the rest of the bracket 14.

Figure 10:
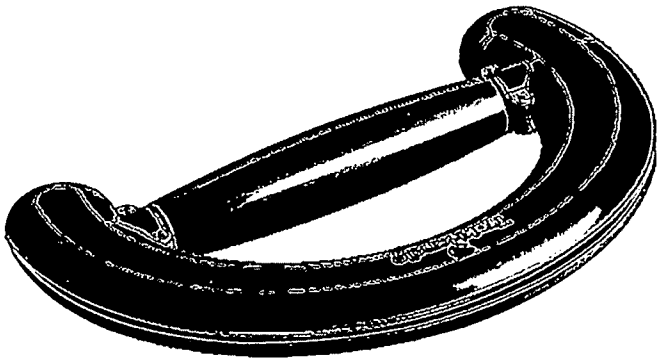
FIG. 10 is a perspective view of the present invention with a hollow track and slot around the outer perimeter.

FIG. 10 shows an embodiment of this invention similar to that described in FIGS. 5A and/or 5B, with a slot that extends around the outer perimeter of the track, which allows a bracket or tab and thus the point of attachment to travel around the circumference of the track.

Figure 11:
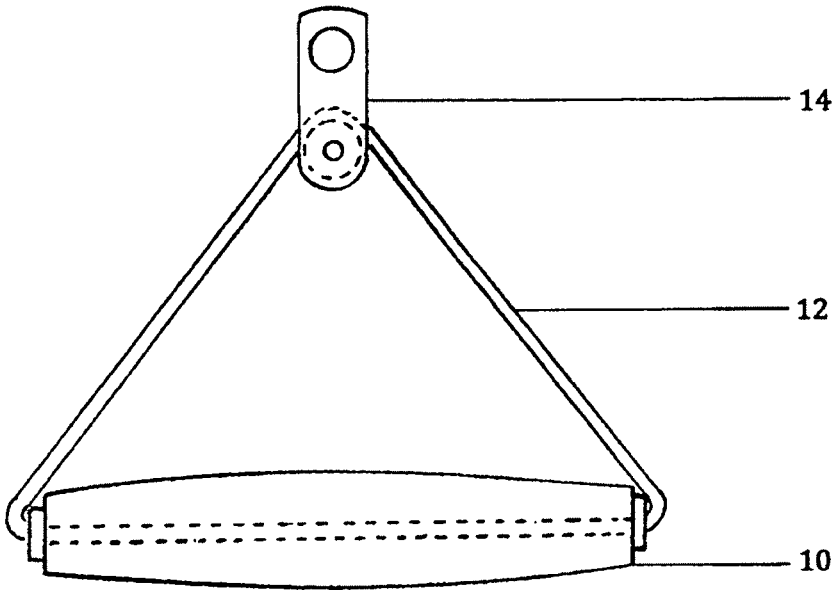
FIG. 11 is a side view of the handle depicted in FIG. 6A.

FIG. 11 shows an alternate embodiment of this invention as described above relating to FIG. 6A, except that track member 12 may comprise a rope, cable, cord or other flexible material. Such flexible material may form a continuous loop that runs through a bored grip 10 and bracket 14. Such flexible material may alternatively be attached to the ends of rod 10A that may extend through grip 10. Track 12 may also be connected to the ends of grip 10 by other means, such as screws, anchors or other fasteners, but preferably by a means that provides for grip 10 to rotate on its longitudinal axis. The length of track 12 may be varied to (i) adjust the position of bracket 14 nearer to or farther from grip 10 or (ii) accommodate handles or grips 10 of shorter and longer lengths. A shorter track 12 may be appropriate for certain movements (for example, exercises involving a pulling motion), while a longer track 12 may be preferable for other movements (for example, pushing exercises common in suspension training). Such longer track 12 would provide for increased movement of the user's hand and arm within track 12 and mitigate the friction and discomfort caused by existing handles. A shorter grip 10 may be preferable for single hand use, whereas a longer grip 10 may be desirable for two-hand use. Bracket 14, in addition to the features described previously, may incorporate a locking mechanism so that a user can temporarily fix the location of bracket 14 at various locations along track 12, thereby eliminating when desirable the instability provided by the otherwise free travel along track 12 by bracket 14.

Figure 12:
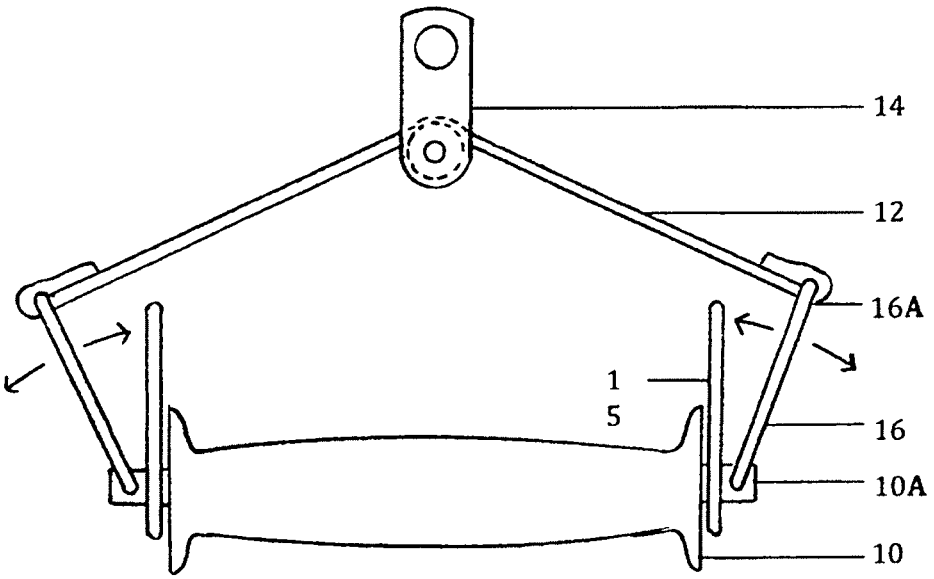
FIG. 12 is a side view of an alternate pull handle of the present invention.

FIG. 12 shows an alternate embodiment of this invention as described above relating to FIGS. 6A and 11, except that track member 12 may comprise a rope, cable or other flexible material that may be attached to transition clips or tabs 16 which in turn may be attached to rod 10A that extends through the length of grip 10. Transition clip or tab 16 may include at its outer end a hole 16*a* through which track 12 may be attached. Track 12 may alternatively be tied around the ends of tabs 16 or attached to tabs 16 by other means. Transition clips or tabs 16 may be attached to rod 10A so that they pivot freely within 180 degrees, from a position perpendicular to one side of rod 10A to a position perpendicular to the opposite side of rod 10A. At either end of grip 10 a flange or hand guard 15 may be affixed perpendicularly between grip 10 and tab 16, extending in the direction of track 12 and tab 16 for a length sufficient to shield the user's hand from contact with track 12 and tabs 16 during use. Such flanges or hand guards 15 may rotate along with track 12 and may be preferably long enough to shield the user's hand but not so long as to impair the movement along track 12 of bracket 14.

Figure 13:
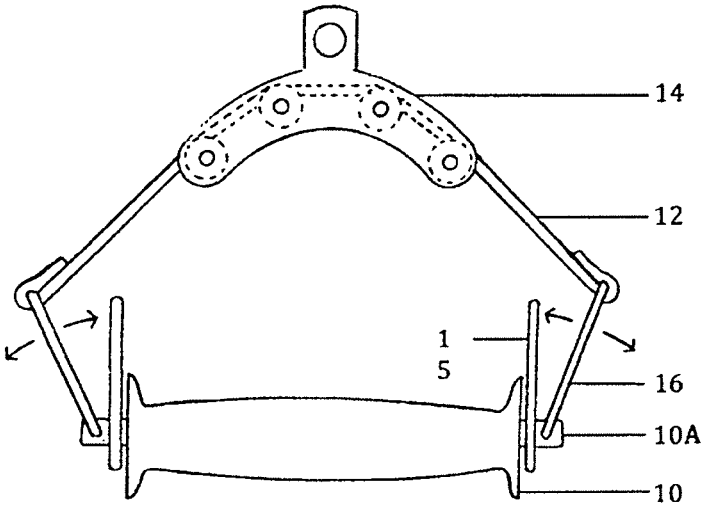
FIG. 13 is a side view of an alternate pull handle of the present invention.
Figure 14:
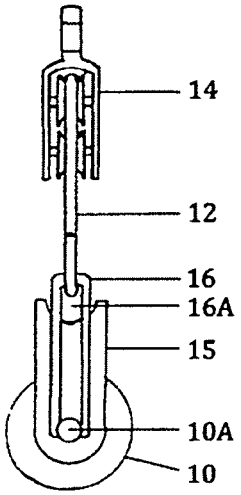
FIG. 14 is an end view of the handle depicted in FIG. 13.

FIGS. 13 and 14 show an alternate embodiment of this invention as described above relating to FIGS. 6A, 11 and 12, except that bracket 14 is revised to provide a wider apex or opening within track 12 at the point of attachment of the resistance. In this embodiment, the angle of the apex created at the point of attachment of the resistance (or, for FIGS. 6A, 11 and 12, by bracket 14) may facilitate certain movements (particularly pushing movements such as those common with chest exercises or suspension training) of the user by increasing the extent to which a user may fit his or her arm or leg within or adjacent to track 12 without discomfort. Certain conventional handle manufacturers produce shorter and longer versions of their handles (especially handles made of nylon strap) to address this issue. However, such handles mitigate only slightly the discomfort caused by the friction where the handle contacts the user's body. Extending bracket 14 as illustrated in either direction along track 12 produces a wider opening at the apex created by bracket 14 and prevents track 12 from coming into contact with the user's arm or leg, thereby alleviating completely the discomfort caused by existing handles. Where grip 10 is widened for two-hand and other applications, bracket 14 may be similarly extended farther in either direction along track 12. As depicted in FIG. 13, bracket 14 may be constructed of metal, plastic or other suitably rigid and durable material and may include one or more pulleys through which track 12 may travel freely. Depending on the composition of track 12 (e.g., rope, cable, strap, band, etc.), bracket 14 may alternatively include roller bearings, wheels or other means of minimizing friction between track 12 and bracket 14. Alternatively, in place of such pulleys, bearings or other means, bracket 14 may employ a smooth low friction surface (for example, a Teflon™-coated surface) over which track 12 could slide. Such pulleys, wheels and other means may be housed within a frame that is contoured or padded on either side to further alleviate discomfort where bracket 14 comes into contact with the user's body.

Bracket 14, in addition to the features described previously, may incorporate a locking mechanism so that a user can temporarily fix the location of bracket 14 at various locations along track 12, thereby eliminating the instability provided by the otherwise free travel by bracket 14 along track 12.

Figure 15:
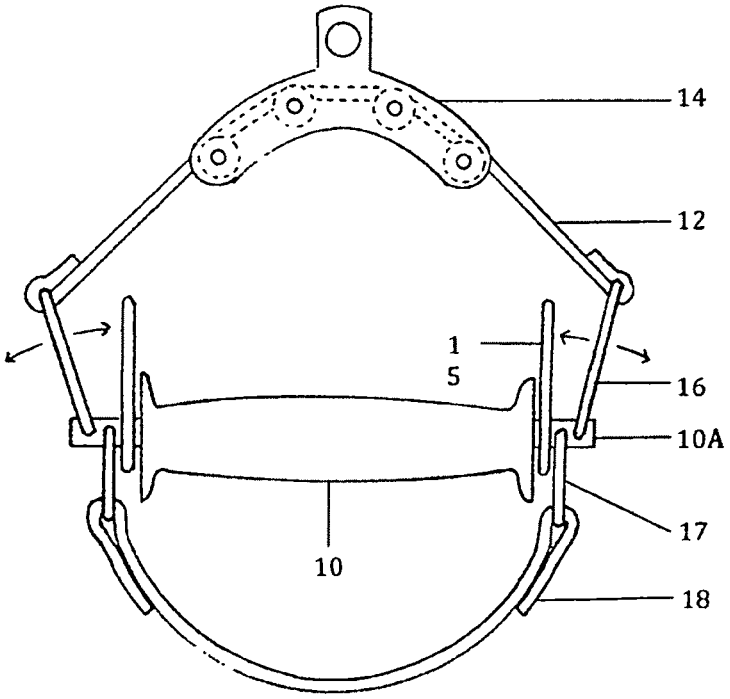
FIG. 15 is a side view of an alternate pull handle of the present invention having a strap for the user's foot.
Figure 16:
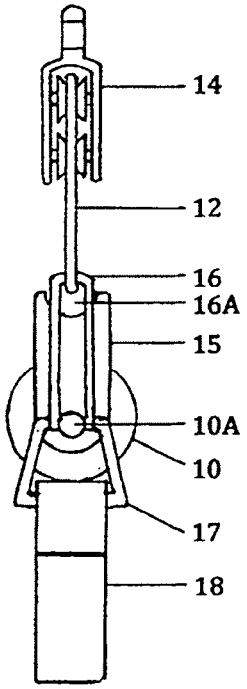
FIG. 16 is an end view of the handle depicted in FIG. 15.

As illustrated in FIGS. 15 and 16, the handle of the invention may be adapted for Pilates, suspension training and other uses and exercises where the user needs to engage the handle with his or her foot. A strap 18, which may be removable (e.g., with hook and loop fasteners), may be attached to the handle by means of an additional pair of tabs 17 that are attached to rod 10A and extend in the direction opposite to that of track 12.

Figure 17:
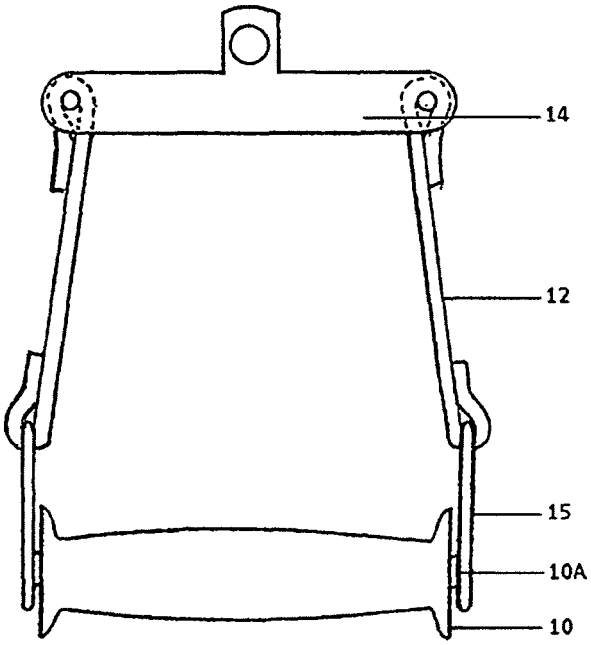
FIG. 17 is a side view of an alternate pull handle of the present invention.
Figure 18:
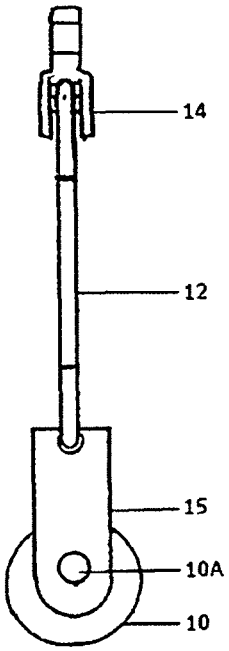
FIG. 18 is an end view of the handle depicted in FIG. 17.

FIGS. 17 and 18 show an alternate embodiment of this invention as described above relating to FIG. 13, except that bracket 14 may be fixed in location and need not travel along track 12. In this alternate embodiment, bracket 14 acts as a lever that pivots in relation to the source of resistance with hook 15 serving as the fulcrum. In this manner, handle or grip 10 may rotate relative to the source of resistance, thereby protecting the user. To maintain equal lengths of track 12 during use, tabs 16 (described above) may be eliminated and track 12 may be attached directly to hand guards 15. As illustrated, track 12 may comprise two equal lengths of rope, cable, cord, strap or other flexible material. However, track 12 may also be made from steel, aluminum, composites or other materials having suitable strength and corrosion resistance and may be either rigid or flexible. As illustrated, track 12 may be connected at one end to an attachment point at one end of bracket 14 and at the other end to hand guard 15. As illustrated, track 12 may be looped through a hole (as attached to hand guard 15) or around a pin (as attached to bracket 14). However, track 12 may be attached by way of screws, rivets or other fasteners suitable for the material used for track 12. Track 12 may alternatively consist of one piece that is attached at either end to hand guards 15 and that continues through or over bracket 14 and which is affixed to bracket 14 by use of fasteners, adhesive or other means.

A second preferred embodiment of the ergonomic pull handle of the current invention is shown in FIGS. 19, 19A, 19B, 19C and 19D. As shown, pull handle 1 may include a handle or grip 10 which may be grasped by the user and track 12 attached to handle 10, such as being attached at the ends of handle 10. Grip 10 is preferably round and textured so that it is comfortable for the user to grasp and will limit slipping, or it may be oblong or other shape and may have a smooth finish or other texture. Track 12 is preferably a flexible vinyl coated steel cable for strength, durability and corrosion resistance. However, a cable, rope or cord or flat band or strap of solid or braided material offering similar strength and flexibility may be used for track 12. As discussed in more detail below, bracket 14 may travel along track 12 during use.

Figure 19:
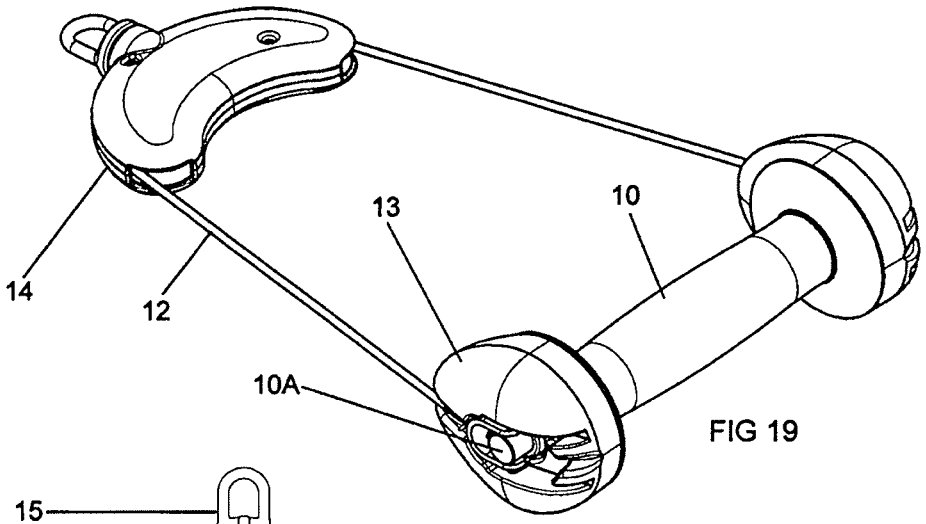
FIG. 19 is a perspective view of a preferred embodiment of the present invention.
Figure 19A:
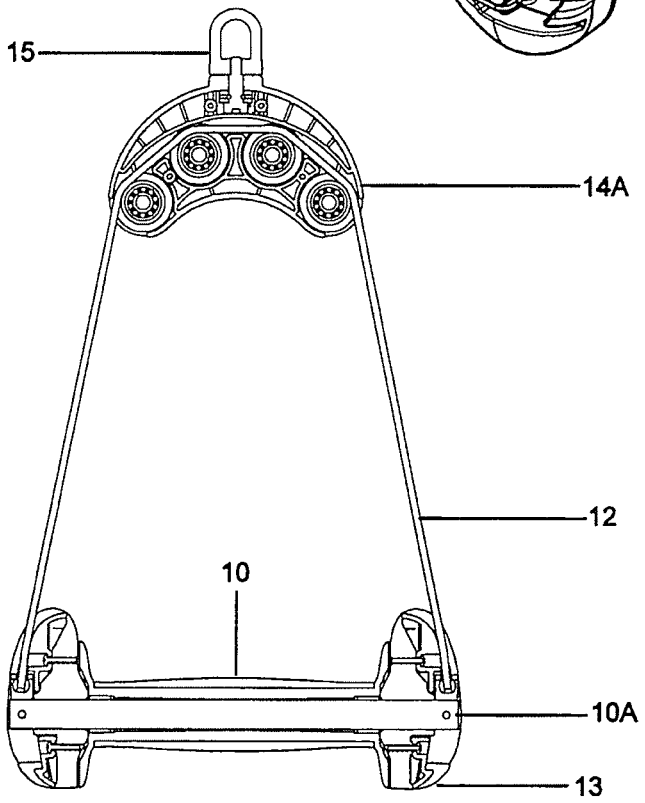
FIG. 19A is a cutaway view of the pull handle of FIG. 19.
Figure 19B:
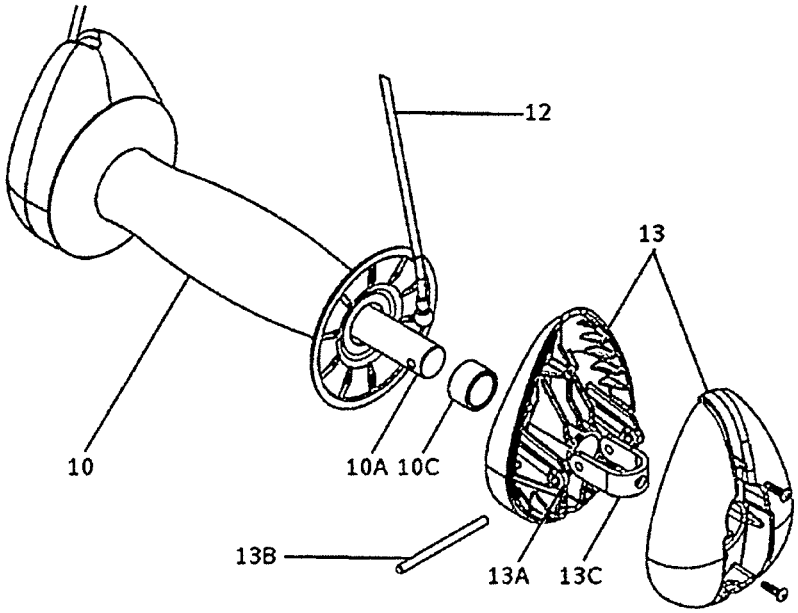
FIG. 19B is an assembly drawing of the connection between the handle, rod, shroud and track.

As shown in FIGS. 19A and 19B, handle or grip 10 may include a bore or hollow section through which rod 10A extends. Handle or grip 10 may preferably be made with nylon for a combination of strength and lightness but may be made with composites, aluminum or other materials or combinations thereof. Handle or grip 10 may preferably rotate about axis X of rod 10A. The ends of rod 10A preferably are bored diametrically to receive pins 13B and extend beyond the ends of handle 10 to engage shroud 13 and track 12 as described later. Rod 10A may preferably be machined from aluminum for strength, lightness and corrosion resistance (such as resistance to sweat), but may be made with composites or other materials. Bushings 10C may be positioned between handle 10 and rod 10A to allow handle 10 to rotate about its axis X and to prevent friction between handle 10 and rod 10A.

Also, as shown in FIGS. 19, 19A and 19B, shroud 13 may be attached to either end of rod 10A for the purposes of protecting the user's hand from contact with track 12 and maintaining proper alignment and support of track 12 during use. Shroud 13 may include a groove to maintain proper alignment of track 12. Said groove may be curved to prevent track 12 from bending at a sharp angle, thus protecting track 12 from excessive wear and extending its functional life. Shroud 13 may comprise two or more parts, as illustrated, or consist of one piece. Shroud 13 may preferably be made with nylon for a combination of strength, lightness and corrosion resistance but may be made with composites, aluminum or other materials or combinations thereof. Shroud 13 may include a bore through which rod 10A may extend and may include anchors 13A to retain pin 13B. Shroud 13 may be attached to rod 10A by means of pin 13B that may be inserted through anchors 13A and diametrically through rod 10A.

Track 12 may be attached to either end of rod 10A by means of hook 13C. Hook 13C may preferably be made with steel but may be made with composite or other materials having similar strength characteristics. Hook 13C may be U-shaped such that the open end of hook 13C straddles rod 10A and may contain holes through which pin 13B may be inserted, thereby securing hook 13C to rod 10A and shroud 13. Hook 13C may contain at its curved end a hole through which track 12 may be inserted and secured with a ball or other suitable fitting. Track 12 may alternatively be looped around the curved end of hook 13C and secured by a knot, sleeve or other fitting suitable for the material used for track 12. Track 12 may be attached to rod 10A through alternative means, such as a ring, flange, fork, etc., and may involve screws, rivets or other fasteners. In this or other suitable manner, grip 10 is rotatably coupled to track 12. The rotation thus provided allows a degree of movement of the ergonomic pull handle 1 thereby protecting the user. In this manner, for example, the pull handle provides a direction or type of motion between the user and the weight or resistance to which the pull handle is attached.

Figure 19C:
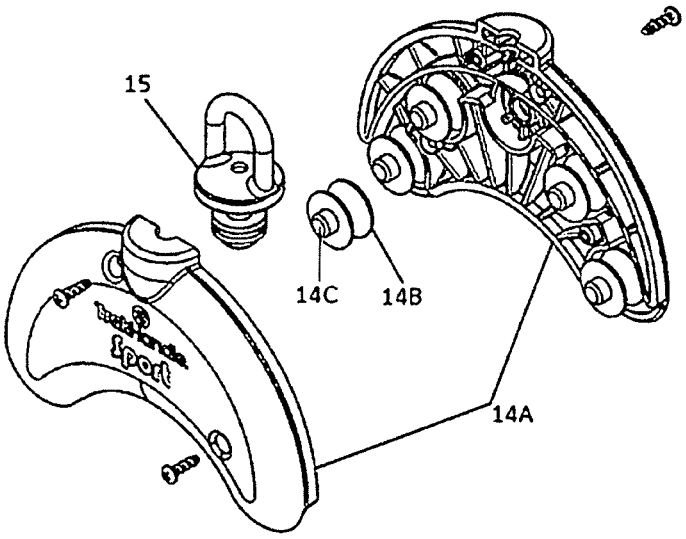
FIG. 19C is an assembly drawing of the bracket, including housing, sheaves, anchor and hook.
Figure 19D:
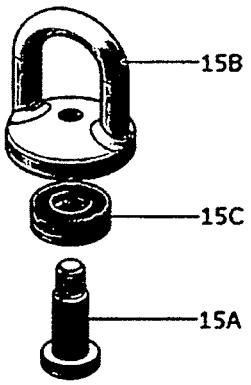
FIG. 19D is an assembly drawing of the anchor, bearing and hook.

As shown in FIG. 19C, bracket 14 may include a housing 14A comprising two halves that may contain therein one or more sheaves 14B over which track 12 is able to move freely. To minimize friction, sheaves 14B may be mounted on bearings 14C. Alternatively, sheaves 14B may be mounted on an axle, bolt or pin which is made of a material having low friction properties, or friction may be reduced through the use of a lubricant. Depending on the composition of track 12, rollers or other bearings may be used in place of sheaves 14B. Alternatively, housing 14A may include a low friction smooth channeled or flat surface over which track 12 is able to slide without the need for sheaves, rollers or the like. Housing 14A and sheaves 14B may be preferably made of nylon for strength, lightness and corrosion resistance (such as resistance to sweat), but may be made with composites, steel, aluminum or other materials. The inside of each half of housing 14A may preferably contain holes to receive the ends of bearings 14C such that when assembled, bearings 14C are secured at either end and sheaves 14B are secured within housing 14A and aligned on a single plane. Each half of housing 14A may also contain a pocket to retain hook assembly 15. As shown in FIG. 11D, the hook assemble may comprise three parts. Anchor 15A may preferably be a bolt extending outward from housing 14A in the direction opposite that of track 12. Attached to the exposed end of anchor 15A may be a hook 15B that enables bracket 14, and therefore handle 11, to be attached to a source of resistance. To enable hook 15B to rotate relative to bracket 14, a thrust bearing 15C may be installed on anchor 15A and retained within housing 14A to provide smooth rotation of anchor 15A. Hook assembly 15 may alternatively incorporate a swivel outside housing 14A or be designed in other ways that provide for such rotation. Anchor 15A and hook 15B may preferably be made from stainless steel for strength and corrosion resistance, but may be made with composites or other materials with suitable tensile strength to support heavy weight.

In use, bracket 14 will be able to slide along the track 12 thereby providing another degree of movement of the ergonomic pull handle 1 thereby further protecting the user as the user extends through a range of motion. Bracket 14 will also spread open track 12 at its apex, thereby accommodating the user's arm or leg during use. Bracket 14 also shields the user's body from contact with track 12 and hook assembly 15, thereby alleviating discomfort during use. And bracket 14 enables pull handle 1 to rotate freely relative to the source of resistance, thereby protecting the user and the equipment being used.

Hook 15B may also be altered, or fitted with attachments that will allow the handle to be connected to a variety of exercise and sports equipment, e.g., resistance bands or tubes, lever type exercise equipment, kite boards, etc. Alternatively, the handle of the invention may be attached to a variety of other equipment such as a suitcase or the end of a cable that is pulled to start a lawn mower.

Handle or grip 10 may also be altered, or fitted with attachments that will replicate a baseball, football, golf club grip or other sports and exercise equipment, thereby facilitating realistic training of sport-specific and other functional movements.

The pull handle 1 of the current invention and the components thereof are preferably comprised of suitably strong materials such as those typically used in the construction of exercise equipment e.g., steel, aluminum and/or other metals, plastic, nylon, PVC, fiberglass and/or other composite type materials, or any other suitable materials that may add to the function, strength, and/or comfort of the invention.

The current invention has many other applications beyond exercise equipment. For example, pull handle 1 could be attached to the end of the cable that is pulled to start a lawn mower or other engine. This invention has significant benefit in this application because the user typically gives the cable a good tug thereby increasing stress. In another application, pull handle 1 may be attached to a cable or rope used in sports, e.g., a tow rope for a water skier, a kite string, or the chords on a sail such as those used in kite boarding.

Referring again to the use of pull handle 1 with exercises, a number of exercises for which the pull handle 1 may be used are described below. In the following exercises, the pull handle 1 is referenced as the TRAK HANDLE™.

Cable Hammer Curl

1. Start with your right arm. Set the cable pulley approximately knee height. Stand facing the pulley so that your right shoulder is centered on the pulley and your feet are perpendicular to the pulling line, with about 12 inches of space between your toes and the front of the pulley.

2. Grip the TrakHandle™ in your right hand so that the grip is in a vertical position as though you are holding a hammer.

Position your upper arm so it is pointing straight down along your side and your upper arm is pointing towards the pulley. Keep your back straight and chest out. This is your starting position.

3. Flex your arm, bringing the TrakHandle™ up towards your shoulder. Do not rotate your wrist during the movement. Your upper arm should remain in its downward position throughout the movement.

4. Return to your starting position. That is one repetition.

Repeat the same process for your left arm while standing to the left side of the pulley.

Kneeling High Pulley Rotation Curl

1. Use a cross over cable system and set both pulleys at their highest setting. Stand between the pulleys. Grip the TrakHandle™ in each hand with the track facing your palm. Lower yourself to a kneeling position with your knees slightly behind the pull line. Straighten your arms so that they are in line with the cable, with your palms facing down. Keep your back straight and chest out. This is your starting position.

2. Keep your upper arms stationary with your elbows pointing up towards the pulleys. Flex your arms while rotating your hands, wrist and forearms, bringing the handles down to your shoulders.

3. Return to your starting position. Make sure your upper arms remain in position throughout the movement. That is one repetition.

Alternate #1: Do not rotate your arms on as you return to the starting point. Work your biceps using the negative resistance. Your palms will be facing up at the end of the repetition. Then rotate your palms down before you begin your next repetition.

Rotating Cable Curl

1. Use a cross over cable system and set both pulleys at their lowest setting. Stand between the pulleys with your feet slightly behind the pull line. Grip a TrakHandle™ in each hand with the track facing your palms. Extend your arms straight pointing towards the pulleys so they are in line with the cables, with your palms facing back. Keep your back straight and chest out. This is your starting position.

2. Flex your arms, while rotating your hands and wrists up towards the ceiling. Bring your hands up towards your collar bones. Your palms should be facing your chest at the end of the movement. Your upper arms should remain locked in position, pointing down at the pulleys, throughout the movement.

3. Return to your starting position. That is one repetition.

Alternate #1: Do not rotate your arms on as you return to the starting point and work your biceps using the negative resistance. Your palms will be facing forward at the end of the repetition. Rotate your palms towards the back and begin your next rep.

Rotating Cable Drag Curl

1. Use a cross over cable system and set both pulleys at their lowest setting. Stand between the pulleys with your feet slightly behind the pull line. Grip the TrakHandle™ in each hand with track facing your palm. Extend your arms straight towards the pulleys so they are in line with the cables, with your palms facing back. Keep your back straight and chest out. This is your starting position.

2. Flex your arms and move your elbows back and up, while rotating your hands, wrists, and elbows towards the ceiling. Bring your hands up to the sides of your chest. Your palms should be facing up at the end of the movement.

3. Return to your starting position. That is one repetition.

Alternate #1: At the top of the movement, swing your elbows down and then up in front, while moving your hands and the TrakHandle™ up to the front of your shoulders. Squeeze your biceps. Reverse this movement, and then finish the second part of the repetition.

Alternate #2: Do not rotate your arms on as you return to the starting point and work your biceps using the negative resistance. Your palms will be facing forward at the end of the repetition. Rotate your palms towards the back and begin your next rep.

Standing High Pulley Rotation Curl

1. Use a cross over cable system and set both pulleys at their highest setting. Stand between the pulleys with your feet slightly behind the pull line. Grip the TrakHandle™ in each hand with the track facing your palms. Hold you arms straight out to your sides with the palms of your hands facing down. Keep your back straight and chest out. This is your starting position.

2. Keeping your upper arms stationary and parallel to the floor, flex your arms while rotating your hands, wrist and forearms. Pull the handles as close as you can to your clavicles.

3. Return to your starting position. Make sure your upper arms remain in the horizontal position throughout the movement. That is one repetition.

Alternate #1: Do not rotate your arms on as you return to the starting point. Work your biceps using the negative resistance. Your palms will be facing up at the end of the repetition. Then rotate your palms down before you begin your next repetition.

Rotational Decline Fly

1. Use a cross over cable system and set both pulleys at their highest setting. Stand between the pulleys with your heels in front of the pull line. Grip a TrakHandle™ in each hand with the hook slide on the same side as the back of your hand. Extend your arms straight, pointing up towards the pulleys, so they are in line with the cables. Position the back of your hands so they are facing up and lean forward, keeping your back straight, chest out, and your knees and hips slightly bent. Find a balance with the weight you are using. Contract your shoulder blades and open your rib cage. This is your starting position.

2. Bend your arms only slightly and contract your pectorals while pulling your arms and shoulders down and forward. Rotate your hands and arms so your palms end up facing each other and bring your hands together at abdomen level. Bring your forearms as close together as you comfortably can and close your rib cage.

3. Return to your starting position. That is one repetition. Note: Throughout this movement, your torso should remain in a fixed position. Avoid rocking back and forth.

Rotational Fly

1, Use a cross over cable system and set both pulleys at just below chest height. Stand between the pulleys with your heels in front of the pull line. Grip a TrakHandle™ in each hand with the track facing the back of your hand. Extend your arms so they are pointing straight towards the pulleys and in line with the cables. Position the back of your hands so they are facing down and lean slightly forward, keeping your back straight, chest out, and your knees and hips slightly bent. Find a balance with the weight you are using. Contract your shoulder blades and open your rib cage. This is your starting position.

2. Bend your arms only slightly and contract your pectorals while pulling your arms and shoulders forward. Rotate your hands and arms so your palms end up facing each other and bring your hands together at face level. Bring your forearms as close together as you comfortably can and close your rib cage.

3. Return to your starting position. That is one repetition. Note: Throughout this movement, your torso should remain in a fixed position. Avoid rocking back and forth.

Rotational Incline Fly

1. Use a cross over cable system and set both pulleys at their lowest setting. Stand between the pulleys with your heels in front of the pull line. Grip a TrakHandle™ in each hand with the hook slide facing the back of your hand. Extend your arms so they are pointing straight towards the pulleys and are in line with the cables. Position the back of your hands so they are facing down and lean slightly forward, keeping your back straight, chest out, and your knees and hips slightly bent. Find a balance with the weight you are using. Contract your shoulder blades and open your rib cage. This is your starting position.

2. Bend your arms only slightly and contract your pectorals while pulling shoulders forward and your arms forward and up. Rotate your hands and arms so your palms end up facing each other and bring your hands together at chest level. Bring your forearms as close together as you comfortably can.

3. Return to your starting position. That is one repetition. Note: Throughout this movement, your torso should remain in a fixed position. Avoid rocking back and forth.

Rotational Iron Cross Chest Press

1. Use a cross over cable system and set both pulleys at their highest setting. Stand between the pulleys with your toes on the pull line. Grip the TrakHandle™ in each. Hold your arms so they are pointing straight towards the pulleys. Turn your hands and forearms so your palms are facing forward. Keep your back straight, shoulders back, chest out, and your rib cage open. This is your starting position.

2. Keeping your arms straight, pull your shoulders and arms down while rotating your hands and arms until your palms are facing backwards and your arms straight down along the front of your hips. Rotate your shoulders forward and close your ribcage towards the end of this movement.

3. Return to your starting position. That is one repetition.

Reverse Decline Rotation

1. Start with a right rotation. Position the pulley at its highest setting. Stand with your left shoulder towards the pulley and your feet parallel to the pulling line. Your feet should be at least shoulder width apart with your toes about 6-12 inches behind the pulling line. Your left foot should be about 18 inches from the pulley.

2. Stand with your back straight, chest out, shoulders square, and your head centered. Hold the TrakHandle™ in your right hand with the hook slide the back of your hand. Rotate your shoulders to the left until they are facing up towards the pulley (keep your spine as straight as possible). Point your right arm at the pulley with your palm facing down. Tighten your stomach and engage all the core muscles of your torso. This is your starting position.

3. Rotate diagonally down and away from the pulley while shifting your weight to your right leg and bending at the right knee and hip. During this movement, extend your right arm out away from your chest and down to the right while rotating your wrist and forearm so that the back of your hand moves away from the pulley. Stop your hips when they are parallel with your toes and continue to rotate around until your shoulders are facing to the right and your arm is pointing down and away from the pulley.

4. Rotate back to your starting position. That is one repetition.

5. Switch right and left in the above directions for your left shoulder.

Reverse Incline Rotation

1. Start with a right rotation. Position the pulley at its lowest setting. Stand with your left shoulder towards the pulley and your feet parallel to the pulling line. Your feet should be at least shoulder width apart with your toes about 6-12 inches behind the pulling line. Your left foot should be about 18 inches from the pulley.

2. Stand with your back straight, chest out, shoulders square, and your head centered. Bend your knees and hips. Hold the TrakHandle™ in your right hand with the hook slide facing the back of your hand. Shift your weight to your left leg, bend at the hips, and rotate your shoulders to the left until they are facing down towards the pulley (keep your spine as straight as possible). Point your right arm at the pulley with your palm facing down. Tighten your stomach and recruit all the core muscles of your torso. This is your starting position.

3. Flex your gluts and straight your leg, while pressing through your left heal. Rotate diagonally up and away from the pulley until you are in a standing position parallel with your toes. During this movement, extend your right arm out away from your chest and up to the right while rotating you wrist and forearm so that the back of your hand moves away from the pulley. You should end facing forward with your right arm extend diagonally up and out to your right side.

4. Rotate back to your starting position. That is one repetition.

5. Switch right and left in the above directions for your left shoulder.

Reverse Rotation

1. Start with a right rotation. Position the pulley at just below chest height. Stand with your left shoulder towards the pulley and your feet parallel to the pulling line. Your feet should be at least shoulder width apart with your toes about 6-12 inches behind the pulling line. Your left foot should be about 18 inches from the pulley.

2. Stand with your back straight, chest out, shoulders square, and your head centered. Bend your knees and hips slightly. Hold the TrakHandle™ in your right hand with the hook slide facing the back of your hand. Contract your core muscles and rotate your shoulders to the left until your facing the pulley. Point your right arm at the pulley with your palm facing down. This is your starting position.

3. Keep your arm straight and shoulders square. Engage your back muscles and rotate around to your right, starting at your hips. Extend your right arm out away from your chest while rotating your wrist and forearm so that the back of your hand ends facing to the right. Stop your hips when they are parallel with your toes and continue to rotate around until your shoulders are facing to the right. Keep your left arm raised throughout the movement so that the cable passes under your left arm.

4. Rotate back to your starting position. That is one repetition.

5. Switch right and left in the above directions for your left shoulder.

Kneeling Rotational Lat Pull Down

1. Use a cross over cable system and set both pulleys at the highest setting. Stand between the pulleys with your feet centered on the pull line. Grip a TrakHandle™ in each hand. Extend your arms so they are pointing straight towards the pulleys and so they are in line with the cables. Position the back of your hands so they are facing up and lower yourself so you are kneeling on the pull line, with your back straight and chest out. Keep your shoulders down and extend your arms up towards the pulleys. Expand your rib cage and relax your back and abdomen. This is your starting position.

2. Contract your entire back. Flex your arms while pulling your elbows down towards the back of your hips. At the same time, rotate your hands until your palms are facing towards you. Contract your abdomen and rib cage while you are pulling down.

3. Return to the starting position while relaxing your back and abdomen and expanding your rib cage. Keep your shoulders down. That is one repetition.

Rotational Iron Cross Back Press

1. Use a cross over cable system and set both pulleys at their highest setting. Stand between the pulleys with your heels on the pull line. Grip the TrakHandle™ in each. Hold you arms and shoulders so they are pointing straight towards the pulleys. Turn your hands and forearms so your palms are facing down. Keep your back straight, shoulders back, chest out and expand your rib cage. This is your starting position.

2. Recruit your lats and back muscles. Keep your arms straight and pull your shoulders and arms down while rotating your hands and arms until your palms are facing forward and your arms straight down along your sides.

3. Return to your starting position. That is one repetition.

Rotational Lat/Trap Contraction

1. Use a cross over cable system and set both pulleys at chest height. Stand between the pulleys with your toes about 12 inches behind the pull line. Grip a TrakHandle™ in each hand. Extend your arms so they are pointing straight towards the pulleys, and are in line with the cables. Position the back of your hands so they are facing backwards and lean back, keeping your back straight, chest out, and your knees and hips slightly bent. Find a balance with the weight you are using. Extend your shoulders towards the pulleys. This is your starting position.

2. Contract your lower traps and upper lats. (The muscles between and below your shoulder blades.) Pull your shoulders back and flex your arms, while pulling your elbows back towards the muscles you are contracting. At the same time, rotate your hands until your palms are facing down.

3. Return to the starting position. That is one repetition. Note: Throughout this movement, your torso should remain in a fixed position. Avoid rocking back and forth.

Rotational Lower Lat Contraction

1. Use a cross over cable system and set both pulleys above head height. Stand between the pulleys with your toes 12 inches or more behind the pull line. Grip a TrakHandle™ in each hand. Extend your arms so they are pointing straight towards the pulleys and are in line with the cables. Position the back of your hands so they are facing backwards and lean back, keeping your back straight, chest out, and your knees and hips bent so you are in a near sitting position. Find a balance with the weight you are using. Extend your shoulders towards the pulleys. This is your starting position.

2. Contract your lower traps just above your lumbar region. Rotate your shoulders to the back and flex your arms while pulling your elbows back towards the muscles you are contracting. At the same time, rotate your hands until your palms are facing down.

3. Return to the starting position. That is one repetition. Note: Throughout this movement, your torso should remain in a fixed position. Avoid rocking back and forth.

Rotational Mid Lat Contraction

1. Use a cross over cable system and set both pulleys at about chin height. Stand between the pulleys with your toes about 12 inches behind the pull line. Grip a TrakHandle™ in each hand. Extend your arms so they are pointing straight towards the pulleys, and are in line with the cables. Position the back of your hands so they are facing backwards and lean back, keeping your back straight, chest out, and your knees and hips bent so you are slightly squatting. Find a balance with the weight you are using. Extend your shoulders up towards the pulleys. This is your starting position.

2. Contract the middle of your back. Pull your shoulders back and flex your arms while pulling your elbows back towards the muscles you are contracting. At the same time, rotate your hands until your palms are facing down.

3. Return to the starting position. That is one repetition. Note: Throughout this movement, your torso should remain in a fixed position. Avoid rocking back and forth.

Bent Arm Rotational lateral Shoulder Raise

1. Start with your right shoulder. Position the pulley at knee height. Stand with your left shoulder towards the pulley and your feet parallel to the pulling line. Your feet should be about shoulder width apart with your toes about 6 inches from the pulling line. Your left foot should be at least 6-12 inches from the pulley.

2. Grip the TrakHandle™ with your right hand. Bend your arm 90 degrees with your upper arm pointing straight down along your right. Position your hand so the back of your hand is facing to your right. Keep your back straight and chest out. This is your starting position.

3. Lock your forearm, wrist and hand in this 90 degree position. Keep your shoulders square and rotate your arm up and out to the right. The back of your hand will be facing up at the top of the movement. The hook will naturally slide around the TrakHandle™ to accommodate this movement.

4. Return to your starting position. That is one repetition.

5. Switch right and left in the above directions for your left shoulder.

Cross Over Rotational Shoulder Raise

1. Start with your right shoulder. Position the pulley at the bottom setting. Stand with your right shoulder towards the pulley and your feet parallel to the pulling line. Your feet should be about shoulder width apart with your toes about 6 inches from the pulling line. Your right foot should be at least 12 inches from the pulley.

2. Grip the TrakHandle™ with your right hand so the track is facing the back of your hand. Extend your right arm straight towards the pulley so that your arm is in line with the cable, and the back of your hand is facing the equipment. Keep your back straight and chest out. This is your starting position.

3. Keeping your arm straight and shoulders square lift your arm up and diagonally away from the pulley so your hand crosses in front of your forehead. Rotate your hand, wrist, and arm, so that the back of your hand faces away from the pulley at the top of the movement.

At the beginning of the movement, you should bend slightly at the right knee and hip, while keeping your back straight. As you start the movement, straighten your leg and hips while pressing through your right heal and engaging your gluts.

4. Reverse your movements and return to the starting position. That is one repetition.

5. Switch right and left in the above directions for your left shoulder.

Rotational Lateral Shoulder Raise

1. Start with your right shoulder. Position the pulley at the bottom setting. Stand with your left shoulder towards the pulley and your feet parallel to the pulling line. Your feet should be about shoulder width apart with your toes a few inches from the pulling line. Your left foot should be at least 6-12 inches from the pulley.

2. Grip the TrakHandle™ with your right hand. Hold your arm straight down along your right side with your hand slightly towards the front and the back of your hand facing forward. Keep your back straight and chest out. This is your starting position.

3. Keep your arm straight and shoulders square, lift your arm straight out to the right while rotating your hand, wrist and forearm, so the back of your hand is facing up at the top of the movement.

4. Return to your starting position. That is one repetition.

5. Switch right and left in the above directions for your left shoulder.

Rotational Lat/Trap Contraction

1. Use a cross over cable system and set both pulleys at chest height. Stand between the pulleys with your toes about 12 inches behind the pull line. Grip a TrakHandle™ in each hand. Extend your arms so they are pointing straight towards the pulleys, and are in line with the cables. Position the back of your hands so they are facing backwards and lean back, keeping your back straight, chest out, and your knees and hips slightly bent. Find a balance with the weight you are using. Extend your shoulders towards the pulleys. This is your starting position.

2. Contract your lower traps and upper lats. (The muscles between and below your shoulder blades.) Pull your shoulders back and flex your arms, while pulling your elbows back towards the muscles you are contracting. At the same time, rotate your hands until your palms are facing down.

3. Return to the starting position. That is one repetition. Note: Throughout this movement, your torso should remain in a fixed position. Avoid rocking back and forth.

Rotational Mid Trap Contraction

1. Use a cross over cable system and set both pulleys at knee height. Stand between the pulleys with your toes about 12 inches behind the pull line. Grip a TrakHandle™ in each hand. Extend your arms so they are pointing straight towards the pulleys and so they are in line with the cables. Position the back of your hands so they are facing forward and lean back, keeping your back straight, chest out, and your knees and hips slightly bent. Find a balance with the weight you are using. Extend your shoulders towards the pulleys. This is your starting position.

2. Contract the middle of your traps (between your shoulder blades). Pull your shoulders back and flex your arms, while pulling your elbows back towards the muscles you are contracting. At the same time rotate your palms towards the ceiling. Flex your arms only enough to facilitate a good contraction of your middle traps.

3. Return to the starting position. That is one repetition. Note: Throughout this movement, your torso should remain in a fixed position. Avoid rocking back and forth.

Rotational Upper Trap Shrug

1. Use a cross over cable system and set both pulleys at their lowest setting. Stand between the pulleys with your toes 6-12 inches behind the pull line. Grip a TrakHandle™ in each hand. Extend your arms straight, pointing towards the pulleys, so they are in line with the cables. Position the back of your hands so they are facing forward and lean back, keeping your back straight, chest out, and your knees and hips slightly bent. Find a balance with the weight you are using. Extend your shoulders out and down towards the pulleys. This is your starting position.

2. Engage your traps and shrug your shoulders. Bring your shoulders up towards the base of your skull, and pull the TrakHandles™ in the direction of your arm pits while flexing your arms, bringing your elbows back and rotating your hands towards the ceiling. Flex your arms only enough to facilitate a good contraction of your upper traps.

3. Return to the starting position. That is one repetition. Note: Throughout this movement, your torso should remain in a fixed position. Avoid rocking back and forth.

Crossover Rotating Triceps Extension

1. Start with your right arm. Position the pulley at the head height. Stand with your left shoulder towards the pulley and your feet parallel to the pulling line. Your feet should be about shoulder width apart with your toes about 6 inches from the pulling line. Your left foot should be 6-12 inches from the pulley.

2. Grip the TrakHandle™ with right hand with the track facing the back of your hand. Point your upper arm straight down along your right side. Bend your arm at your elbow and roll your shoulder slightly forward, so your forearm and wrist are pointing upwards towards the pulley. Place your right hand over the left side of your chest with your palm facing your chest. This is the starting position.

3. Extend your forearm out and down to your side while rotating your wrist and forearm so that your palm ends up facing forward at the end of the movement.

4. Return to the starting position. That is one repetition. Switch right and left in the above directions for your left arm.

Hammer Triceps Extension

1. Start with your right arm. Set the pulley cable approximately head height. Stand facing the pulley so that your right shoulder is centered on the pulley and your feet are perpendicular to the pulling line, with about 12 inches between your toes and the front of the pulley.

2. Grip the TrakHandle™ in your right hand with the track facing the back of your hand. Hold the grip in a vertical position as though you are holding a hammer and so your palm is facing left. Keep your upper arm pointing down along your side and bend your elbow so your forearm and hand are pointing up towards the pulley. This is the starting position.

3. Extend your arm until it is pointing straight down along your side. Do not rotate your wrist during the movement. Your palm should remain facing the left throughout the movement. Keep your upper arm stationary throughout the movement.

4. Return to the starting position. That is one repetition.

5. Switch left and right in the above directions for your left arm.

Rotating Reverse Triceps Extension

1. Start with your right arm. Set the pulley cable approximately head height. Stand facing the pulley so that your right shoulder is centered on the pulley and your feet are perpendicular to the pulling line, with about 12 inches between your toes and the front of the pulley.

2. Grip the TrakHandle™ in your right hand with the track facing the back of your hand. Hold the grip in a vertical position as though you are holding a hammer and so your palm is facing left. Keep your upper arm pointing down along your side and bend your elbow so your forearm and hand are pointing up towards the pulley. This is the starting position.

3. Extend your arm until it is pointing straight down along your side, while rotating your hand, wrist and forearm upwards towards the ceiling. Your palm will end up facing forward at the end of the movement. Keep your upper arm stationary throughout the movement.

4. Return to the starting position. That is one repetition.

5. Switch left and right in the above directions for your left arm.

Rotating Triceps Extension

1. Start with your right arm. Set the pulley cable approximately head height. Stand facing the pulley so that your right shoulder is centered on the pulley and your feet are perpendicular to the pulling line, with about 12 inches between your toes and the front of the pulley.

2. Grip the TrakHandle™ in your right hand with track facing the back of your hand. Hold the grip in a vertical position as though you are holding a hammer and so your palm is facing left. Keep your upper arm pointing down along your side and bend your elbow so your forearm and hand are pointing up towards the pulley. This is the starting position.

3. Extend your arm until it is pointing straight down along your side, while rotating your hand, wrist and forearm down towards the floor. Your palm will end up facing back at the end of the movement. Keep your upper arm stationary throughout the movement.

4. Return to the starting position. That is one repetition.

5. Switch left and right in the above directions for your left arm.

Although certain presently preferred embodiments of the invention have been described herein, it will be apparent to those skilled in the art to which the invention pertains that variations and modifications of the described embodiments may be made without departing from the spirit and scope of the invention.

What is claimed is:

1. A pull handle for performing exercise, comprising:

a flexible member having first and second ends;

a hand grip that includes a bore rotatable relative to the flexible member;

a rod that extends through the bore and that has first and second ends that are coupled to the first and second ends of the flexible member;

a first shroud at each end of the rod that separates the flexible member from the hand grip;

a second shroud at each end of the hand grip that separates the first shroud from a user's hand; and a bracket through which the flexible member travels.

2. The pull handle of claim 1, wherein the rod includes one or more bushings or bearings to separate the rod form the hand grip and to allow the hand grip to rotate more freely about the rod.

3. The pull handle of claim 1, wherein the first and second ends of the rod are connected to the flexible member with a transition clip having first and second ends, whereas the first end of the transition clip is coupled to the flexible member and the second end of the transition clip is coupled to the rod.

4. The pull handle of claim 1, further comprising one or more pulleys or rollers which are located in the bracket and on which the flexible member travels.

5. The pull handle of claim 1 wherein the bracket is configured to attach to a source of resistance.

6. The pull handle of claim 5 wherein the bracket includes an eyelet to attach to a source of resistance.

7. The pull handle of claim 6, wherein the eyelet is configured to rotate about an axis.

* * * * *